US006640867B1

(12) United States Patent
Pallotta et al.

(10) Patent No.: US 6,640,867 B1
(45) Date of Patent: Nov. 4, 2003

(54) RELEASABLY ATTACHABLE SHADES

(75) Inventors: Shawn Christopher Pallotta, Maineville, OH (US); Von Adoniram Kinsey, Loveland, OH (US)

(73) Assignee: The Procter & Gamble Company, Cincinnti, OH (US)

( * ) Notice: Subject to any disclaimer, the term of this patent is extended or adjusted under 35 U.S.C. 154(b) by 0 days.

(21) Appl. No.: 10/209,238

(22) Filed: Jul. 31, 2002

(51) Int. Cl.[7] ..... E06B 3/94

(52) U.S. Cl. ..... 160/84.04; 160/84.05; 160/84.06

(58) Field of Search ..... 160/84.04, 84.05, 160/84.06, 84.01, 405

(56) References Cited

U.S. PATENT DOCUMENTS

| | | | | | |
|---|---|---|---|---|---|
| 3,580,323 | A | | 5/1971 | Gossling et al. | |
| 4,539,238 | A | | 9/1985 | Markowitz | |
| 4,544,011 | A | * | 10/1985 | Sawamura | 160/84.04 |
| 4,655,003 | A | | 4/1987 | Henley, Sr. | |
| 4,880,044 | A | * | 11/1989 | Judkins | 160/84.04 |
| 4,880,045 | A | | 11/1989 | Stahler | |
| 4,934,435 | A | * | 6/1990 | Regev | 160/84.04 |
| 4,951,730 | A | | 8/1990 | Hsu | |
| 5,158,127 | A | | 10/1992 | Schumacher | |
| 5,176,192 | A | * | 1/1993 | Judkins et al. | 160/84.04 |
| 5,263,529 | A | | 11/1993 | Landis | |
| 5,273,097 | A | * | 12/1993 | Siegler | 160/84.04 |
| 5,443,563 | A | | 8/1995 | Hindel et al. | |
| 5,566,735 | A | * | 10/1996 | Jelic | 160/84.04 |
| 5,690,156 | A | * | 11/1997 | Ruggles | 160/84.04 |
| 5,701,940 | A | * | 12/1997 | Ford et al. | 160/84.05 |
| 5,862,850 | A | * | 1/1999 | Yang | 160/84.04 |
| 6,033,504 | A | | 3/2000 | Judkins | |
| 6,056,035 | A | | 5/2000 | Laster-Bivens | |
| 6,192,962 | B1 | | 2/2001 | Glover | |
| 6,196,292 | B1 | | 3/2001 | Jackson | |
| 6,257,300 | B1 | * | 7/2001 | Brownlie | 160/84.01 |
| 6,345,486 | B1 | * | 2/2002 | Colson et al. | 160/84.05 |

* cited by examiner

*Primary Examiner*—David Purol
(74) *Attorney, Agent, or Firm*—Larry L. Huston; Leonard W. Lewis; Steven W. Miller

(57) ABSTRACT

A shade for covering and uncovering an opening. The shade is attachable to drawstrings which raise and lower or otherwise move the end of the shade to obscure/reveal more or less of the opening, as desired. The shade is attachable to the drawstrings through attachments which comprise slots, etc. The attachments do not require threading of the drawstrings through holes in the shade. The shades are conveniently removable from the drawstrings and optionally disposable so that different shades may be coordinated with room colors, seasonal events, etc.

18 Claims, 5 Drawing Sheets

RELEASABLY ATTACHABLE SHADES

FIELD OF INVENTION

The present invention relates generally to shutters, blinds and other coverings, collectively referred to as shades, for windows, doorways and other permanent and temporary apertures and openings.

BACKGROUND OF THE INVENTION

Shutters and blinds typically have a plurality of horizontally oriented rotatably adjustable slats. Typically, such shades comprise an assembly of plural individual slats. Each slat must be individually replaced if it is desired to change a slat due to any reason, such as damage, soiling, etc. The slats are vertically spaced apart and hang from a plurality of depending drawstrings. The drawstrings must be threaded through each individual slat. By "thread" or "threading",it is meant that the hole in the shade or attachment is circumscribed by a solid periphery, and the drawstring is necessarily inserted through the hole in a direction generally perpendicular to the plane of such hole. In contrast, according to the present invention, the drawstring may be inserted without threading. Instead of threading, the drawstring may be inserted into the attachment in a lateral or radial direction, providing speed and convenience to the user. Shades having vertically oriented slats are also known in the art, and suffer from much of the same disadvantages, as shades having horizontally oriented slats.

Shades also include cellular and single panel embodiments. Such shades typically are suspended from a header by a plurality of drawstrings. These shades often comprise a plurality of horizontal pleats, through which the drawstrings are threaded. These shades provide the benefit that a unitary assembly can be inserted and removed to cover the opening, but also have the disadvantage of requiring threading of the drawstrings through individual pleats.

Frequently, the user will wish to provide a pattern, coloring or aesthetically pleasing indicia on the shade. For example, U.S. Pat. No. 5,263,529, iss. Nov. 23, 1993 to Landis, teaches individual decals being applied to the slats of horizontally oriented blinds. Each decal contains a portion of the desired design. When the individual slats are viewed together, an entire design is formed. U.S. Pat. No. 5,443,563, iss. Aug. 22, 1995 to Hindel et al., teaches a shade secured to a roller and having a high definition print applied to the face of the shade. The shade is treated to make it non-stretchable. U.S. Pat. No. 3,580,323, iss. May 25, 1971 to Gossling et al., teaches a blind having a decorative scalloped edge. However, these references fail to teach a shade having a design which is conveniently removable and replaceable. Each of these attempts in the art requires complex disassembly and reassembly if the user wishes to change the color, pattern, or other aesthetic effect of the shade. Disassembly/reassembly are equally complex if one wishes to change another feature of the shade, such as its size or position on the opening.

U.S. Pat. No. 6,033,504, iss. Mar. 7, 2000 to Judkins, teaches an exemplary honeycomb type of cellular window covering suspended from two pairs of cords. Another attempt in the art is U.S. Pat. No. 6,056,035, iss. May 2, 2000 to Laster-Bivens. Laster-Bivens teaches an apparatus for hanging various styles of shades, and comprising four depending draw cords. The individual draw cords are threaded through a hanging grid at discrete predetermined locations. To "simplify" the installation process, the draw cords may be secured with quick release stops. However, both of these attempts in the art still require the time consuming task of threading cords or strings through individual holes in the shades.

An attempt to overcome threading individual cords or strings through individual holes is given by U.S. Pat. No. 6,192,962 B1, iss. Feb. 27, 2001 to Glover. Glover teaches a telescoping support bar and window treatment panels which are joined together by hook and loop fasteners. When the consumer desires to change the panel, the hook and loop attachment means are released and a new panel applied. However, Glover does not teach easily replaceable pleated shades which are raised and lowered by the user.

Another attempt to forego threading drawstrings through individual holes is found in U.S. Pat. No. 5,158,127, iss. Oct. 27, 1992 to Schumacher. Schumacher teaches a temporary covering fastened to the top of the window frame by an adhesive fastening strip and adjusted to length by a pair of clipping means. Schumacher's adhesive does not allow for permanent or even long term attachment of the temporary covering. Yet, another attempt is found in U.S. Pat. No. 4,880,045, iss. Nov. 14, 1989 to Stahler. Stahler teaches a flexible window shade assembly having a pair of guide tracks 30 which receive and support the window shade assembly. Stahler is not suitable for use with the existing infrastructure, which primarily relies upon the draw cords disclosed above. U.S. Pat. No. 6,196,292 B1, iss. Mar. 6, 2001 to Jackson, discloses a venetian blind window covering comprising two individual blinds. The individual blinds are detachably secured together, one on top of the other. The blinds may be individually changed or independently controlled by the user. However, the Jackson blinds are not suitable for relatively short windows, and, more significantly, do not allow the user to conveniently change the size or appearance of the entire blind system.

U.S. Pat. No. 4,655,003, iss. Apr. 7, 1987 to Henley, Sr., teaches a shutter assembly with individually removable slats. Henley does not require the assembly to be threaded through drawstrings. Instead, each slat is provided with a dowel at each end. The dowel fits into vertically spaced sockets in the side rails. The Henley assembly does not allow for removal and insertion of a new assembly all at once, nor is Henley usable with the pleated shades so popular today.

U.S. Pat. No. 4,539,238, iss., Sep. 3, 1985 to Markowitz also teaches a window shade comprising strips connected by severable connecting threads. The strips may be torn from each other if one wishes to remove an individual strip for sizing. Markowitz, like Henley, fails to teach a way to conveniently change the entirety of a window shade.

Accordingly, there is a need in the art to accommodate convenient removal and insertion of window shades. Particularly, there is a need to provide removal and insertion of shades which do not require threading individual strings or cords through individual holes in a shade. Further, the need exists for convenient insertion and removal of the popular pleated shades in use today.

SUMMARY OF THE INVENTION

The invention comprises an apparatus for at least partially obscuring or covering an opening. The apparatus comprises a header. The header is attachable to the periphery of the opening and particularly may be attachable to the frame of the opening, if provided. The apparatus further comprises at least one drawstring extending away from the header and in operative association with the header. Also provided is a shade. The shade has a proximal end juxtaposed with the header and a distal end opposed thereto. The shade has a plurality of attachments attachable to the drawstring. The shade is operatively associated with the drawstring without threading the drawstring through holes in the shade. In operation, the distal end of the shade may be moved towards or away from the header by operation of the drawstring.

If desired, the shade may be pleated and/or cellular. Multiple drawstrings and/or an external motor for automated operation of the shade may be provided. The shade is conveniently removable from the balance of the apparatus in order that the user may easily replace the shade, as desired.

All documents cited are, in relevant part, incorporated herein by reference; the citation of any document is not to be construed as an admission that it is prior art with respect to the present invention.

DETAILED DESCRIPTION OF THE INVENTION

Figure 1:
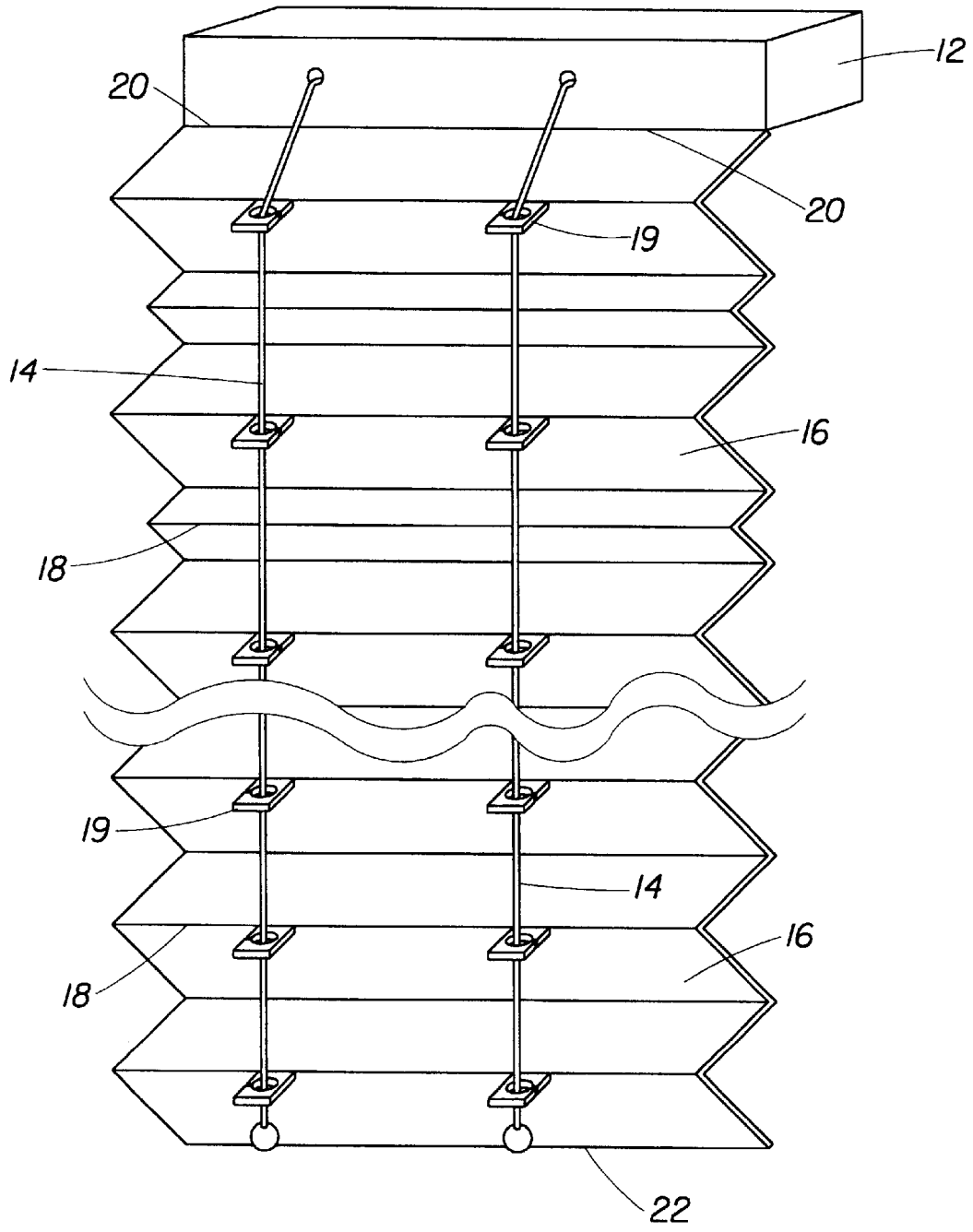
FIG. 1 is a broken perspective view of a pleated shade according to the present invention, having unequally sized pleats in the upper half, within internally facing slots on the attachments and equally sized pleats with externally facing slots on the lower half.

Referring to FIG. 1, the apparatus 10 comprises a header 12. The header 12 is attachable to the frame of an opening 40. At least one, and preferably a plurality, of drawstrings 14 extend away from the header 12. A shade 16 is suspended from the header 12 by the drawstrings 14.

The header 12 may be horizontally oriented and attached to or juxtaposed with the top of the opening 40. The opening 40 may comprise a window, door, aperture, portal, access panel or any other blind or through hole, as desired. The drawstring(s) 14 depend downwardly from the header 12. The drawstring 14 supports and controls the shade 16. The shade 16 may be pleated. If the shade 16 is pleated, it may have Z-pleats of equal or unequal size. Joined to or otherwise operatively associated with the shade 16 is a plurality of attachments 19, as described below. The attachments 19 are typically juxtaposed with the vertex of the pleat 18, although other locations on the pleat 18, as well as other positions on the shade 16, may be suitable.

The pleated shade 16 is operatively associated with the drawstring 14 in known manner, which will not be repeated here, so that the shade 16 may be moved relative to the opening 40. Particularly, the shade 16 has a proximal end 20 juxtaposed with the header 12 and a distal end 22 remote therefrom. When the shade 16 is moved, typically the distal end 22 is moved towards and away from the header 12. The drawstring 14 and shade 16 are operatively associated in a known manner so that the drawstring 14 can operate the shade 16 to obscure and reveal, or cover and uncover, more or less of the opening 40 as desired. In extreme situations, the shade 16 may totally obscure the opening 40, or not obscure it at all. Alternatively, the portion of the opening 40 obscured/revealed by the shade 16 may remain constant while the absolute position of the shade 16 is moved towards and away from different portions of the frame.

The length of the shade 16 is taken from the proximal end 20 to the distal end 22. The width of the shade 16 is perpendicular to its length and lies within the plane of the shade 16. The length and width directions define the plane of the shade 16.

The apparatus 10 is useful for partially or totally obscuring/revealing an opening 40. If the opening 40 is large, the user may not wish to totally obscure the opening 40. For example, if the opening 40 is a large, tall window, the upper portion of the window may remain uncovered and transparent while the lower portion is covered to provide sufficient privacy for the users. The user may wish to allow portions on one side of the window or around the periphery of the window to always remain uncovered, for example, to allow for light entry. It is to be understood that depending upon the needs of the user and the geometry of the opening 40, the apparatus 10 of the present invention may be used to partially or totally obscure/reveal the opening 40.

The opening 40 has a geometry defined by a periphery. The geometry may have any desired shape/aspect ratio, and comprise a periphery having straight sides, curved sides, or combinations thereof. The periphery of the opening 40 is typically bounded by a frame, although it is to be recognized that openings 40 may have one or more undefined sides as, for example, occurs when the top of the opening 40 is not bounded. The frame may only be disposed on one side of the opening 40, may traverse the opening 40, and may be continuous or discontinuous, as desired. The frame of the opening 40 need only be usable for attachment 19 of the apparatus 10 as set forth below. Thus, the frame includes the walls and other members 32 juxtaposed with the opening 40 and suitable for mounting of the apparatus 10. The frame may be integral with the periphery of the opening 40 or may be a separate element.

The drawstring 14 is any flexible element 32 which can operate the shade 16 to obscure/reveal more or less of the opening 40 as desired, or which may serve to change the position of the shade 16 relative to the periphery of the opening 40. Drawstrings 14 are inclusive of strings, cords, chains, belts, and bands which can operate the shade 16 as known in the art. Drawstrings 14 are also inclusive of rigid members 32 flexibly attached to the shade 16 and provide for its operation and movement, such as rotatable handles and articulable levers.

Figure 2:
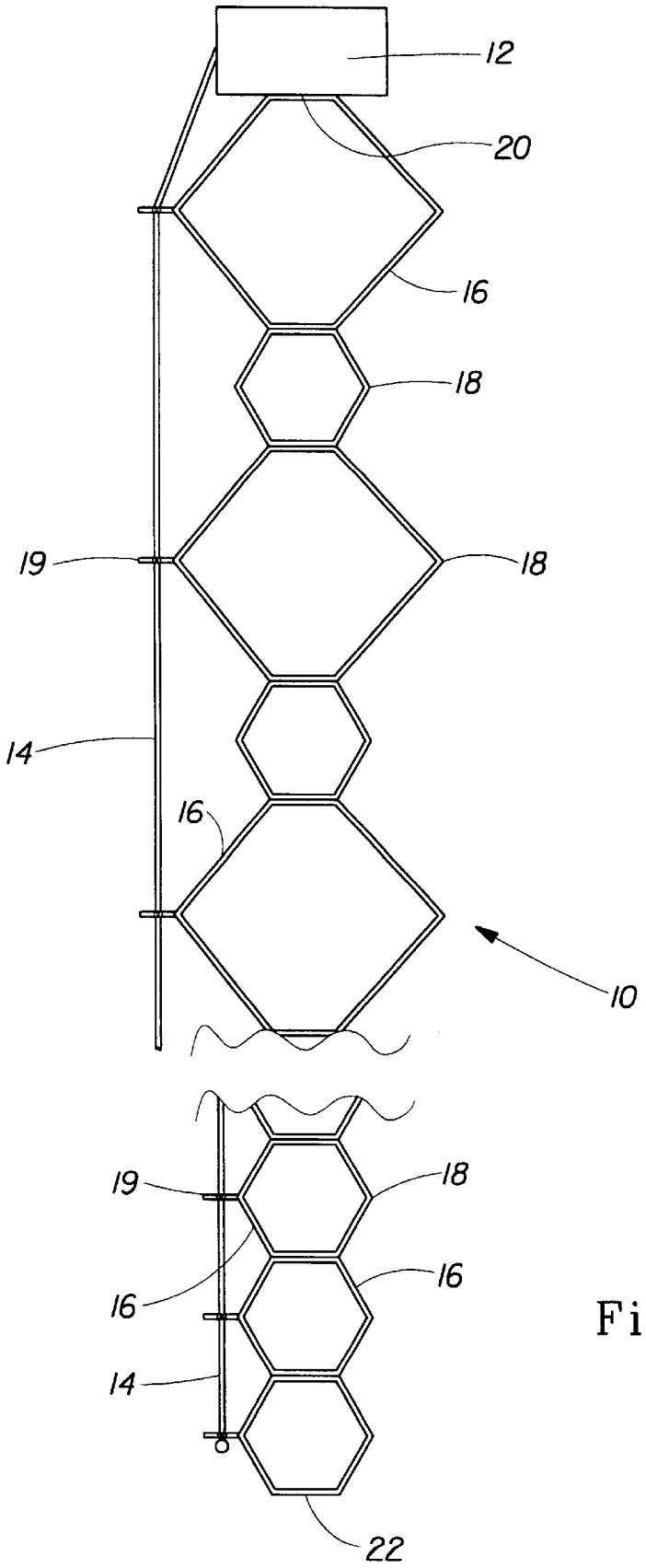
FIG. 2 is a broken side elevational view of a shade similar to that shown in FIG. 1, and being cellular.

Referring to FIG. 2, the shade 16 may optionally comprise at least one, and preferably a plurality of cells, Z pleats, and other known folds. The pleats 18 allow for accumulation of the material forming the shade 16 as it is compressed to reveal more of the opening 40, and also allow for extension of the material to obscure more of the opening 40. The material forming the shade 16 may be elastic or inelastic, as desired. Also, the material forming the shade 16 may be opaque to varying degrees, translucent, or even transparent. If desired, the shade 16 may comprise one or more holes therethrough for viewing, communicating with persons on the opposite side of the shade 16, etc. The shade 16 may be formed of a single piece of material or may comprise at least two pieces of material disposed 180 degrees out of phase. The at least two pieces of material may be alternatingly opaque and transparent and disposed such that when the shade 16 is transposed the amount of light transmitted through the shade 16 can be varied. The pitch and opacity differences between the transparent and opaque areas can be varied, as desired.

If desired, the shade 16 may comprise a flexible panel without pleats 18. Such a panel would be comprised of any flaccid material which can be accumulated or gathered by known means to reveal more or less of the opening 40 as desired. For example, a flat panel embodiment of the shade 16 may be rolled around a tube in known fashion, as illustrated, for example, by U.S. Pat. No. 4,951,730, iss. Aug. 28, 1990 to Hsu.

The attachments 19 are disposed on the shade 16 in any pattern which allows for operation and movement of the shade 16. Preferably, the attachments 19 are spaced apart along the length of the shade 16 in a straight line. This disposition not only accommodates convenient attachment 19 of the drawstrings 14 to the attachments 19, but also allows for simple operation of the drawstrings 14 in known fashion. If a Z pleated or cellular shade 16 is selected, the attachments 19 may be disposed on the vertex of each pleat 18 or cell. Alternatively, attachments 19 may be disposed at other positions on the shade 16. It is not necessary that each pleat 18 of the shade 16 have an attachment 19. It is only necessary that the number of attachments 19 be sufficient to move the distal end 22 of the shade 16 towards and away from the header 12. In an extreme case, a single attachment 19 juxtaposed with the distal end 22 of the shade 16 may be utilized. If the pleats 18 are of unequal size the attachments 19 may be only disposed on the larger pleats 18, which typically extend further outwardly from the plane of the shade 16. Further, a Z pleated or cellular shade 16 may have pleats 18 disposed of in two oppositely facing arrays, a first array oriented towards the opening 40 and a second array of pleats 18 oppositely oriented and facing away from the opening 40. The attachments 19 may be disposed on either the first array, the second array, or both.

Referring to FIGS. 3A–3G, attachments 19 provide for operatively associating the shade 16 with the drawstring 14. Preferably, the attachments 19 do not comprise holes, and thereby avoid the necessity and inconvenience of threading the drawstrings 14 through holes in the attachments 19 or in the shade 16. Instead, the attachment 19 may connect the drawstring 14 to the shade 16 by mechanical engagement, frictional forces, or any other releasably attachable method or mechanism which does not require the inconvenience of threading the drawstrings 14 through holes in the attachment 19 or the shade 16. The attachments 19 may be made of plastic, metal, paper, sheet stock, wire, or any other suitable material.

Figure 3A:
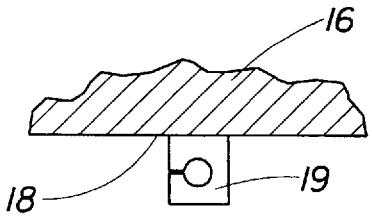
FIGS. 3A–3D are top plan views of externally extending attachments usable with the present invention.
Figure 3B:
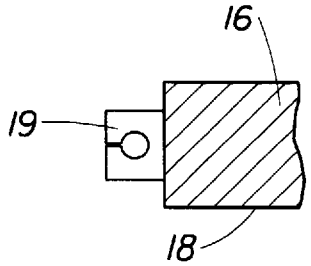
Figure 3C:
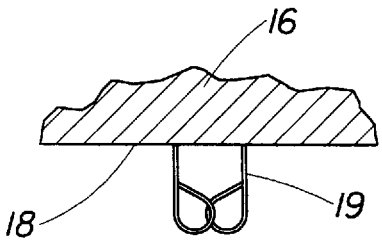
Figure 3D:
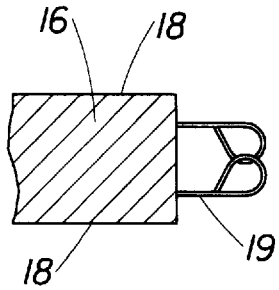
Figure 3E:
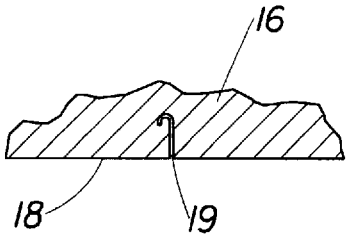
FIGS. 3E–3G are top plan views of internally extending attachments usable with the present invention.
Figure 3F:
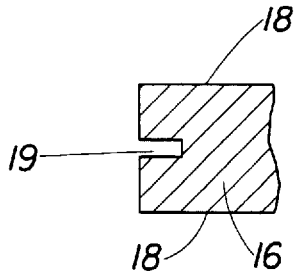
Figure 3G:
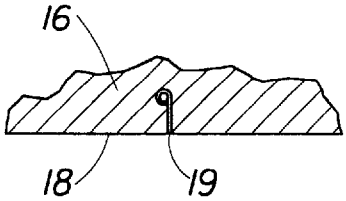

Referring particularly to FIGS. 3A–3D, the attachments 19 may extend outwardly from the shade 16. Each attachment 19 may comprise an open loop. The open loop has a narrow slot through which the drawstring 14 is inserted for attachment 19 of the shade 16, as illustrated in FIGS. 3A–3B. The slot is narrow enough that it is unlikely that and reasonably difficult for the drawstring 14 to become detached from that attachment 19. Alternatively, the attachment 19 may comprise wire loops, clips, and compliant geometries—similar to an "owl clip" style paper clip, as illustrated in FIGS. 3C–3D. The open area of the geometry of the attachment 19 preferably provides for smooth operation of the shade 16. The attachment 19 may be joined to the shade 16 by adhesion, crimping, heat sealing, or various other means known to one of skill in the art. Alternatively, the attachment 19 and shade 16 may be integrally formed at the time of manufacture. Referring to FIGS. 3E–3G, if desired, the attachments 19 may be internal to the shade 16, such as a slot, notch, or other feature cut from or into the shade 16.

FIGS. 3A, 3C, 3E, and 3G show attachments 19 extending perpendicular to the plane of the shade 16. FIGS. 3B, 3D, and 3F show attachments 19 extending outwardly from or internally into the end of the shade 16. FIG. 3E shows a J-shaped slot extending generally perpendicular to the plane of the shade 16. FIG. 3G shows an attachment 19 comprising an open slot terminating at an enlarged hole.

One of skill will recognize that many permutations, combinations, and variations of the foregoing attachments 19 are feasible and within the scope of the claimed invention. For example, the slot type attachments 19 need not have an enlarged hole at the distal end 22 of the slot. Slots may be convergently and divergently tapered. Overlapping type clips, such as the owl type clips illustrated may overlap or not overlap, as desired.

Additionally, one of skill will recognize that variations and combinations in the type of attachments 19 used on a particular shade 16 are feasible. For example, a first type of attachment 19 may be used near the proximal end 20 of the shade 16 while a different type of attachment 19 may be used near the distal end 22 of the shade 16. The same pleat 18 may have plural attachments 19 on it, a single attachment 19, or no attachments 19. If plural attachments 19 are selected for a given pleat 18, the attachments 19 may be alike or different.

Referring back to FIGS. 1–2, the shade 16 may be joined to the header 12 and/or footer using temporary or permanent means well known in the art, including, but not limited to, magnetic attraction, hook-and-loop fasteners, adhesive, etc. The same joining method need not be used for both the header 12 and footer. A greater holding force is required at the header 12 than the footer.

If desired, the shade 16 may have indicia provided thereon. The indicia may comprise any aesthetic pattern, print, or recognizable feature sought by the user. For example, the indicia may be coordinated with the season (Christmas, Easter, Fall, etc.), may comprise sports figures, cartoons for children, color coordinate with the rest of the room or environment in which the shade 16/opening 40 are used, may provide printed instructions for activities carried out in the vicinity of the shade 16, may comprise memorabilia unique to the user, photographs of family, local sites of interest, etc.

The indicia may comprise ink, dye, or any visually aesthetically discernible pattern, including three-dimensional topographies, such as embossments or debossments. Inks or dyes may be applied to the sheet in any number of ways, including, but not limited to: dipping the sheet into the ink or dye, spraying a solution onto the sheet, or preferably by printing. Suitable printing processes include, but are not limited: lithography, letter press, elcography, laser printing, gravure, screen printing, intaglio, flexography, and preferably inkjet printing. The indicia may be a single color image or multi-colored. Inks and devices suitable for printing of the indicia are found in commonly assigned U.S. Pat. No. 6,096,412, iss. Aug. 1, 2000 to McFarland, et al. and U.S. Pat. No. 5,123,037, iss. May 25, 1993 to Leopardi, II, respectively. Embossing may be accomplished according to commonly assigned U.S. Pat. No. 5,294,475. iss. Mar. 15, 1994 to McNeil, or using other well known methods. The image may be centered on the shade 16 as illustrated in the aforementioned U.S. Pat. No. 3,580,323. The indicia may be applied during manufacture and prior to purchase by the user. Alternatively, the image may be applied by the user after purchase. If a symmetrical image is desired, the image should have a border feature which allows for trimming of the shade 16 to the desired size. A single shade 16 may have indicia on both sides, if desired.

In another embodiment (not shown), the shade 16 may comprise alternating rigid elements and flexible joints. The rigid elements are spaced apart by the flexible joints and may have a major dimension disposed parallel to the width and substantially transverse to the length of the shade 16. If desired, the rigid members 32 may span the entire width of the shade 16. The flexible joints may comprise suitable springs. The flexible joints allow for alternating collapse of the space separating the rigid members 32 as the distal end 22 of the shade 16 is retracted towards the header 12. This embodiment is similar to the well known Roman shade which has rigid joints/bars and the material between the bars which is flexible as the bars are raised and lowered, such a shade 16 is attached to the header 12 and optionally a footer. Opposite the shade 16 are the attachments 19 which are operatively associated with the drawstrings 14. The attachments 19 may be connected to the flexible joints or, alternatively, to the rigid members 32. By alternating the rigid members 32 and flexible joints, the shade 16 will preferentially buckle at the flexible joints when the distal end 22 of the shade 16 is retracted towards the header 12.

If desired, a pair of shades 16 may be disposed in parallel and facing each other. This arrangement increases the opacity and thermal barrier provided by the shades 16. Each shade 16 of the pair may be provided with indicia. The indicia may be mutually different or the same. Of course, three or more shades 16 may be disposed in parallel in this manner. Each such shade 16 may have a portion of the total indicia disposed thereon, with the indicia becoming visually clearer as the shade 16 closest to the viewer is seen.

Figure 4:
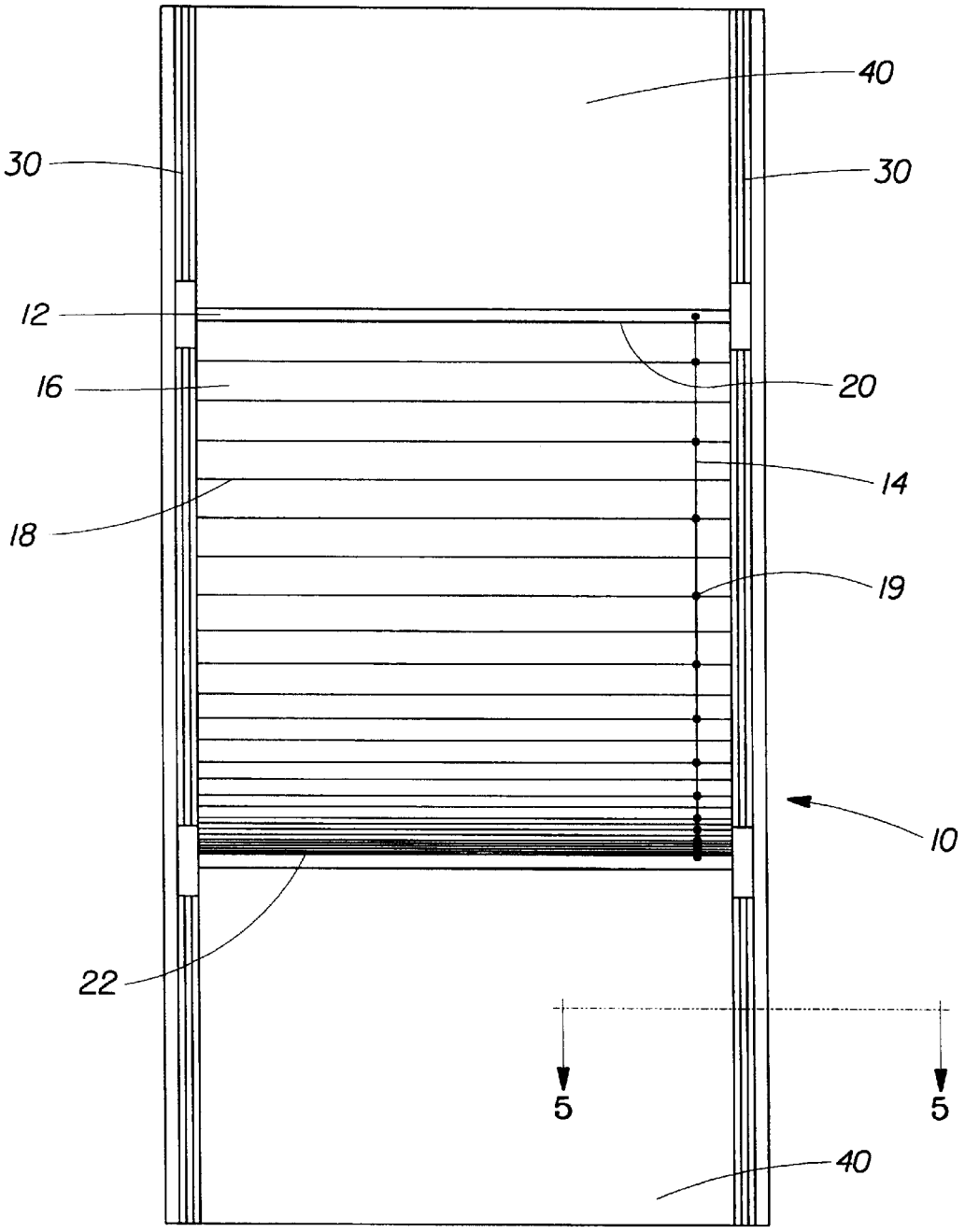
FIG. 4 is a frontal view of a shade according to the present invention being disposed on tracks.

Referring to FIG. 4, the header 12 may be movable, rather than fixed to the frame. For example, tracks 30 may be provided on the sides of the opening 40. One or more members 32 are juxtaposed with the ends of the header 12 and footer (if provided) and attached to tracks 30 to move up and down the tracks 30 to the desired position. This arrangement provides the benefit that more flexibility is available in obscuring/revealing different portions of the opening 40. A particular benefit to this embodiment is that the top of the opening 40 may remain uncovered without drawstrings 14 hanging from the movable header 12 across the opening 40 to the shade 16, as occurs in the prior art.

Figure 5A:
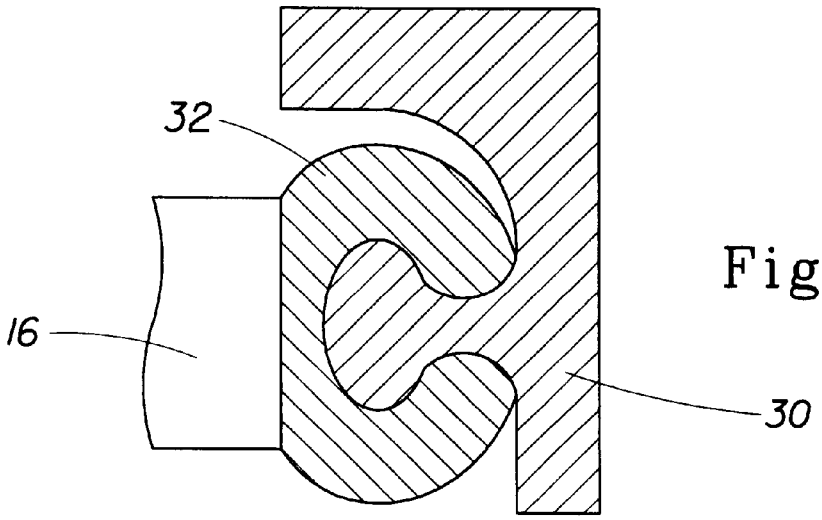
FIGS. 5A–5B are fragmentary vertical sectional views taken along line 5—5 of FIG. 4, showing two different possible constructions, each usable with the shade of FIG. 4.
Figure 5B:
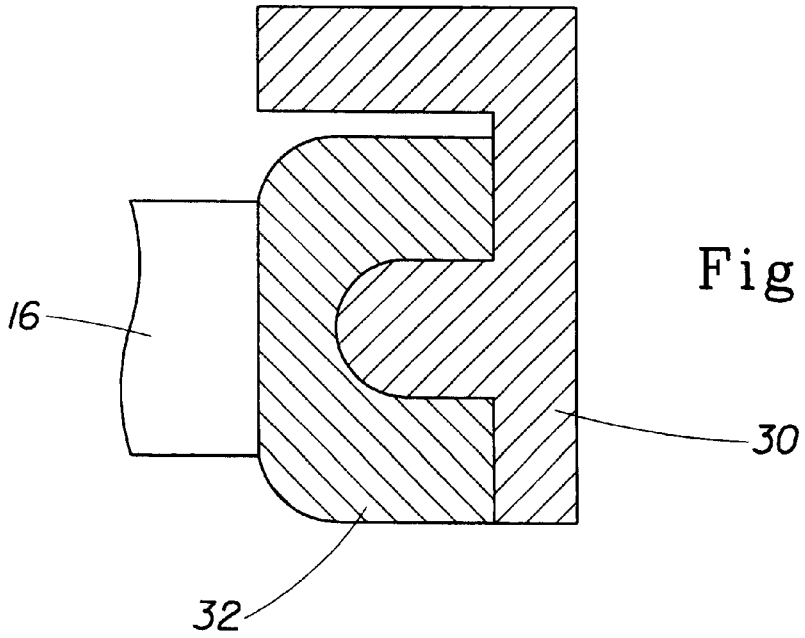

Referring to FIGS. 5A–5B, in such an arrangement, the shade 16 may be attached to the track by a compliant member 32 or by any other method or mechanism which engages the track 30 to hold the shade 16 in the desired position. Such a member 32 may be magnetic, biased or spring loaded, as desired, to provide frictional/mechanical engagement. Alternatively, in such an embodiment the drawstring 14 may be eliminated. A plurality of members 32 may be provided, including one disposed on each end of each pleat 18 of the shade 16. If desired, the members 32 may be integral with and cut into the ends of each pleat 18 of the shade 16.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An apparatus for at least partially obscuring an opening, said opening having a frame, said apparatus comprising a header, said header being attachable to the frame of said opening, at least one drawstring, said at least one drawstring extending away from said header and being operatively associated therewith; and a pleated shade, said pleats being unequally sized, so that said shade comprises pleats of at least two mutually different sizes, said shade having a proximal end juxtaposed with said header and a distal end opposed thereto, said shade having a plurality of attachments attachable to said drawstring, said plurality of attachments being disposed on some of said pleats, whereby at least one pleat does not have attachments juxtaposed therewith, whereby said shade can be operatively associated with said drawstring without threading said drawstring through a holes in said shade, whereby said distal end of said shade can be moved towards and/or away from said header by said at least one drawstring.

2. An apparatus according to claim 1, wherein said at least one drawstring depends downwardly from said header.

3. An apparatus according to claim 2 comprising a pair of drawstrings.

4. An apparatus according to claim 3, further comprising a footer, each said drawstring of said pair being joined to said footer, whereby said footer is oppositely disposed from said header.

5. An apparatus according to claim 1, wherein said attachments extend outwardly from said shade.

6. An apparatus according to claim 5, wherein shade defines a plane and said attachments are substantially perpendicular to said plane of said shade.

7. An apparatus according to claim 1, wherein said attachments extend inwardly into said shade.

8. An apparatus according to claim 7, wherein said attachments comprise a slot, said drawstrings being removably insertable into said slot.

9. An apparatus according to claim 1, wherein said pleated shade comprises a cellular shade.

10. An apparatus according to claim 9, wherein said pleated shade has a plurality of pleats disposed in two oppositely facing arrays, a first array facing a first direction and a second array facing a second direction opposite said first direction, said attachments being associated with said first array of pleats, and wherein each said pleat in said first array has at least one attachment disposed thereon.

11. An apparatus according to claim 9, comprising a pleated shade having alternatingly disposed large pleats and small pleats, said attachments being disposed on said large pleats.

12. A pleated shade, said pleated shade being attachable to a pair of drawstrings, said pleated shade having a first array of pleats oriented in a first direction and a second array of pleats oriented a second direction opposite therefrom, said first array of pleats having a plurality of discrete attachments associated therewith, whereby said discrete attachments may be engaged with drawstrings so that said pleated shade is operatively associated therewith and movable to at least partially cover and at least partially uncover an opening, such shade being attachable to and removable from said drawstrings without threading said drawstrings through said discrete attachments.

13. A shade according to claim 12, wherein said discrete attachments comprise slots, said slots being integral with and internal to said pleats of said shade.

14. A shade according to claim 13, wherein said shade has two oppositely disposed ends and said attachments are juxtaposed with said two ends of said shade.

15. A shade according to claim 14, wherein each said pleat of said first array has at least one attachment associated therewith.

16. A method of covering a window opening bounded by a frame, said method comprising the steps of:

providing a header having at least one drawstring depending therefrom;

attaching said header to the frame of the window opening;

simultaneously providing a plurality of shades, for selection by a user, each of said shades being attachable to and removable from said drawstring, at least some of said shades having mutually different indicia thereon;

each said shade having a plurality of attachments joined thereto, said attachments being open on one end to receive said drawstrings therein;

selecting one shade from said plurality of said shades for use in covering said window opening;

inserting said drawstrings into said attachments of said selected shade, whereby each said attachment of said shade is held in a respective position on said drawstrings; and using said at least one drawstring to raise or lower said selected shade.

17. A method according to claim 16, further comprising the step of removing said selected shade from said at least one drawstring by removing said at least one drawstring from said attachments, thereby freeing said selected shade from said at least one drawstring.

18. A method according to claim 16, further comprising the step of selecting two said shades, and attaching said shades to said header in face-to-face relationship with each other;

thereby providing increased opacity over either shade alone, said shades having mutually different indicia thereon.

* * * * *